US009440155B2

(12) United States Patent
Fischer

(10) Patent No.: US 9,440,155 B2
(45) Date of Patent: Sep. 13, 2016

(54) AMUSEMENT AND LEISURE SLIDE

(71) Applicant: FISCHER DESIGN-CONCEPTS SARL, Etoy (CH)

(72) Inventor: Jean-Francios Fischer, Etoy (CH)

(73) Assignee: FISCHER DESIGN-CONCEPTS SARL, Etoy (CH)

( * ) Notice: Subject to any disclaimer, the term of this patent is extended or adjusted under 35 U.S.C. 154(b) by 0 days.

(21) Appl. No.: 14/388,079

(22) PCT Filed: Mar. 26, 2013

(86) PCT No.: PCT/EP2013/056354
§ 371 (c)(1),
(2) Date: Sep. 25, 2014

(87) PCT Pub. No.: WO2013/144117
PCT Pub. Date: Oct. 3, 2013

(65) Prior Publication Data

US 2015/0045128 A1 Feb. 12, 2015

Related U.S. Application Data

(60) Provisional application No. 61/615,933, filed on Mar. 27, 2012.

(30) Foreign Application Priority Data

Mar. 27, 2012 (EP) ..... 12161573
Oct. 4, 2012 (EP) ..... 12187280

(51) Int. Cl.
*A63G 21/14* (2006.01)
*A63G 21/10* (2006.01)
*A63G 21/18* (2006.01)

(52) U.S. Cl.
CPC ..... *A63G 21/14* (2013.01); *A63G 21/10* (2013.01); *A63G 21/18* (2013.01)

(58) Field of Classification Search
CPC ..... A63B 21/14
See application file for complete search history.

(56) References Cited

U.S. PATENT DOCUMENTS 4,836,521 A * 6/1989 Barber ..... A63G 3/02 104/86
5,433,671 A * 7/1995 Davis ..... A63G 21/18 104/57

(Continued)

OTHER PUBLICATIONS

International Search Report issued in International Application No. PCT/EP2013/056354 dated Jun. 6, 2013.

(Continued)

*Primary Examiner* — Michael Dennis
(74) *Attorney, Agent, or Firm* — DLA Piper LLP US

(57) ABSTRACT

An amusement and leisure slide comprises at least one sliding trail forming a three-dimensional curve supported with fastenings attached to a portion of the sliding trail to an axial part disposed on a support and configured to rotate about a substantially horizontal rotation axis. The sliding trail comprises an inlet arranged in vicinity of the rotation axis of the trail and an outlet allowing a rider to exit the trail. The curve of the sliding trail is configured to form a sliding path between the inlet and the outlet extending in a volume around the rotation axis of the trail, said sliding path being driven by a motor. The sliding trail may include a dry or wet sliding tube, sliding rail(s) for guiding carts or wagons, or a sliding tube provided with rail(s) arranged inside the tube for guiding carts or wagons.

19 Claims, 7 Drawing Sheets

(56) References Cited

U.S. PATENT DOCUMENTS

| | | | | |
|---|---|---|---|---|
| 8,140,202 | B2 * | 3/2012 | Dibble | B61B 13/127 104/53 |
| 2006/0194638 | A1 | 8/2006 | Hunter | |
| 2010/0178993 | A1 | 7/2010 | Hunter | |
| 2012/0129617 | A1 * | 5/2012 | Olive | A63G 21/18 472/116 |
| 2012/0295720 | A1 | 11/2012 | Hunter | |

OTHER PUBLICATIONS

Written Opinion issued in International Application No. PCT/EP2013/056354 dated Jun. 6, 2013.

Anonymous, "Backyard Waterslide Simulator", Grand Idea Studio, XP-002679500, retrieved from http://web.archive.org/web/20100121003928/http://www.grandideastudio.com/portfolio/pt-waterslide-simulator, archived Jul. 9, 2012 (1 page).

* cited by examiner

AMUSEMENT AND LEISURE SLIDE

CROSS REFERENCE TO RELATED APPLICATIONS

This application is a U.S. National Stage Application of International Application No. PCT/EP2013/056354, filed Mar. 26, 2013, which claims priority from U.S. Provisional Patent Application No. 61/615,933, filed Mar. 27, 2012 and European Application Nos. 12161573.6 and 12187280.8, filed Mar. 27, 2012 and Oct. 4, 2012, respectively.

FIELD OF THE INVENTION

The present invention relates to an amusement and leisure slide for attraction parks, hotels, business or shopping centers with various combinations of thrilling experiences. In particular the slide comprises one or several toboggan curved tubes in which a rider slides on a variable slope in a wet or dry environment.

TECHNICAL BACKGROUND

Some conventional slides comprise static curved tubes and take a significantly large space and height to provide a sufficiently long path having a constant or variable downward slope.

For example, document WO2010040978A1 disclose a waterslide apparatus comprising a bowl having a curved sidewall; and two or more rider entrances for enabling riders to slide into the bowl and to circuit at least a portion of the bowl. The waterslide apparatus allows two or more riders to circuit at least a portion of the bowl at the same time. The rider entrances may be provided at different heights in the sidewall of the bowl. A chute or flume is preferably associated with each rider entrance. In use, the riders travel down the chute or flume and enter the bowl with sufficient momentum to travel at least partway around the bowl. The chutes each have an inlet through which a rider enters and an outlet which mates with the rider entrance. The chutes each have a longitudinal axis which proximal the inlet is inclined at an angle of less than or equal to 30° measured relative to the vertical.

Document WO2009141588A2 discloses a system for conveying an individual in a leisure park, the system comprises a tube having an inlet and an outlet; and a rotatable screw for conveying the individual from said inlet to said outlet. The system further comprises an inlet flow control means adapted operatively to cause a surge of water into said inlet suitable for biasing an individual into the tube; and/or an outlet flow control means adapted operatively to cause a surge of water out of said outlet for biasing an individual out of the tube. The surge of water may correspond to an increased flow rate of the water as it enters the inlet and/or exits the outlet. Preferably, the surge of water is sufficient to transport the individual into the inlet and/or out of the outlet respectively. A surge of water into the inlet may ensure that an individual is introduced fully into the tube and is preferably clear of the inlet as the screw rotates. Likewise, a surge of water out of the outlet may ensure that an individual is expelled from the tube and is clear of the outlet as the screw rotates.

A backyard water slide simulator is shown on web site of Grand Idea Studio http://www.grandideastudio.com/portfolio/pt-waterslide-simulator. This simulator comprises a semi-circular tube forming a wheel rotating about its rotation axis and rocking in several directions. A rider slides in the tube supplied with water thanks to the rotation of the wheel driven by a motor and to its simultaneous rocking carried out by hydraulic or pneumatic jacks.

Document U.S. Pat. No. 5,433,671 discloses a transport device for transporting a water ride participant from a first elevation to a second, higher elevation. The device includes a spiral transport element extending generally between the first and second elevations. The spiral transport element has first and second end sections, an intermediate section and an inner surface extending along the intermediate and first and second end sections. The inner surface defines a spiral pathway between the first and second elevations. Further provided is a drive mechanism coupled to the spiral transport element for effecting rotation of the transport element such that the first end section of the transport element is capable of receiving a participant at the first elevation and the second end portion is capable of releasing the participant at the second elevation after the participant has traveled along the spiral pathway from the first elevation to the second, higher elevation.

Document US2006/194638 discloses a flume ride having a funnel-shaped slide feature having a relatively larger entry end and a relatively smaller exit end, the funnel-shaped slide feature being configured and arranged such that a rider enters at the wider end with a predetermined expected velocity and swings back and forth and/or spins around the inner surface of the funnel before safely draining through the smaller end. Optionally, the wider end of the slide feature may be covered so as to darken its interior, and/or the slide feature may be configured such that the rider swings above a vertical portion of the inner surface. Additionally, a flume ride is provided having a plurality of such slide features.

SUMMARY OF THE INVENTION

An aim of the invention is to provide a slide configured to explore new thrill possibilities thanks to a sliding path with a constantly variable slope and a controlled sliding duration.

The aim is achieved by an amusement and leisure slide comprising at least one sliding trail forming a three-dimensional curve supported with fastenings linking at least one portion of the sliding trail to an axial part disposed on a support, said axial part being configured to rotate about a substantially horizontal rotation axis, characterized in that:

- the sliding trail includes a first end forming an inlet arranged in vicinity of the rotation axis at an end of the axial part and a second end, distinct from the first end, forming an outlet allowing to exit the trail,
- the curve of the sliding trail is configured to form a sliding path between the inlet and the outlet extending in a volume around the rotation axis, said sliding path being maintained on a slope by a rotation of the sliding trail about the rotation axis, said rotation being driven by a motor.

Riding is almost infinite since gravity height loss is compensated by the rotational energy provided by the curved sliding trail. As a rider slides on the trail between the inlet and the outlet and dissipates energy by friction, the average potential energy is maintained thanks to the rotation of the trail.

The rider enters the trail by the inlet placed near the rotation axis, preferably during rotation of the sliding trail for providing a more intense thrill level than entering a static one, and for avoiding having to stop the rotating structure during operation.

The rider exits the sliding trail by the outlet when rotation stops after a given time. In some cases, the rotation can also be maintained or slowed down while the rider exits the sliding trail in particular in a pool of an aquatic slide.

An advantage of the slide according to the invention is that the overall dimensions are significantly reduced in relation to the ones of conventional slides which are relatively cumbersome for similar performances regarding especially sliding speed, sliding path length and sliding duration. At the same time, entering a rotating structure is providing better and new thrills compared to entering a static one.

The sliding trail may be made up of a dry or wet sliding tube(s), sliding rail(s) for guiding carts or wagons or a sliding tube provided with rail(s) arranged inside the tube for guiding carts or wagons.

BRIEF DESCRIPTION OF THE FIGURES

The invention will be better understood with the following detailed description, which refers to the attached figures given as non-limitative examples.

DETAILED DESCRIPTION OF THE INVENTION

The FIGS. 1 to 8 illustrate preferred configurations of the slide comprising a sliding trail in form of a sliding tube, but these configurations may also be applied to slides wherein the sliding trail is made up of a single or multiple sliding rail(s) for guiding carts or wagons or a sliding tube provided with rail(s) arranged inside the tube for guiding carts or wagons.

Figure 1:
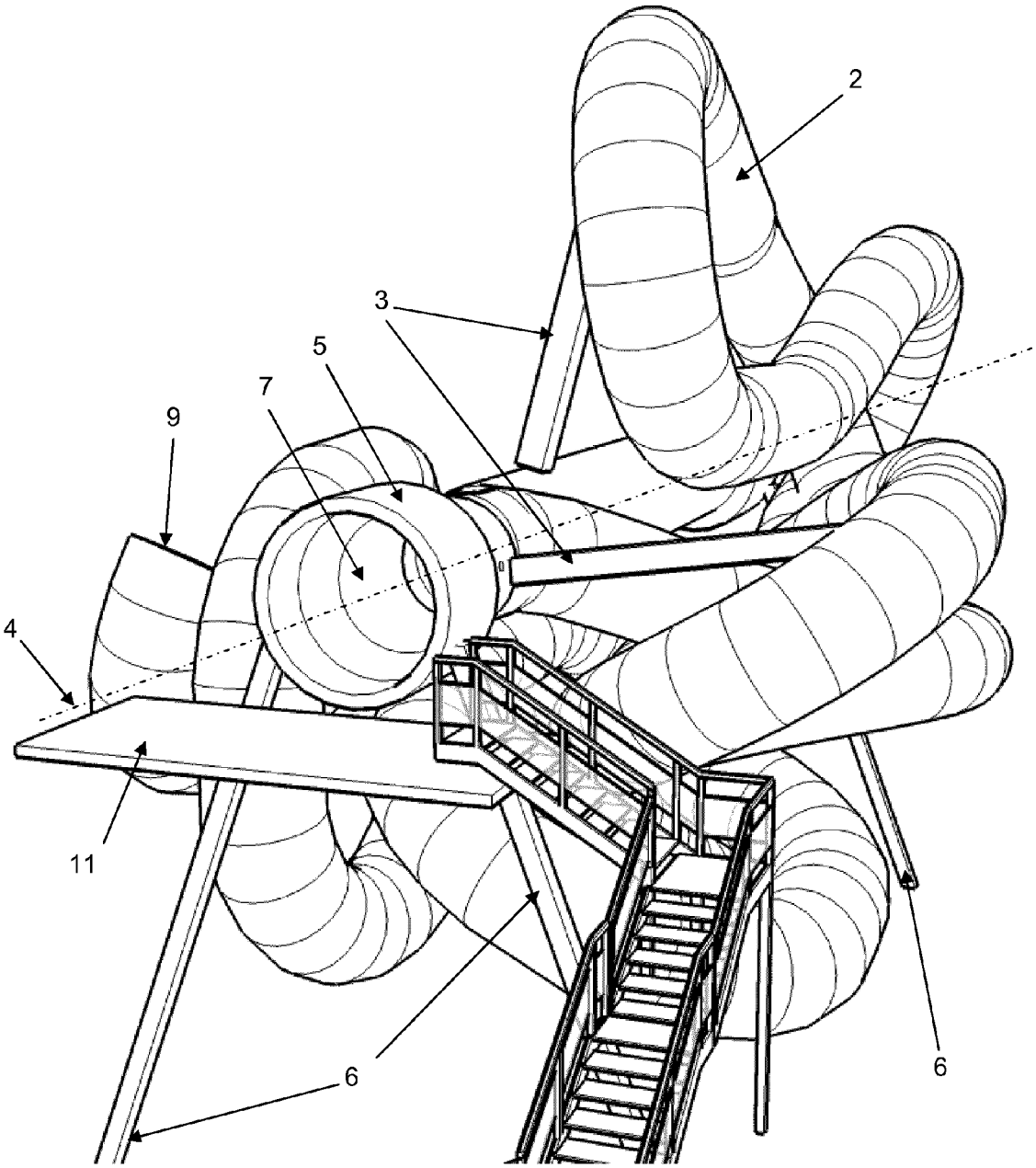
FIG. 1 shows an embodiment of the slide of the invention with a three-dimensional curved tube rotating about a horizontal axis of a portion of the tube disposed on a support and maintaining the curve formed by the tube.

According to a first embodiment illustrated by FIG. 1, the slide of the invention comprises a sliding trail (2) made up of a tube having a substantially circular shaped section forming a three-dimensional curve occupying a volume around the rotation axis (4). The shape of the section of the tube may also be elliptic, oval, or other convex rounded shape without sharp angles. The trail is supported with fastenings (3) linking at least portions of the sliding trail to an axial part (5) disposed on a support (6). Portions of the sliding trail may also be linked each other with fasteners (3) if required by the shape of the trail curve. The axial part (5) is configured to rotate about a substantially horizontal rotation axis (4). The sliding trail (2) includes a first end forming an inlet (7) arranged in vicinity of the rotation axis (4) at an end of the axial part (5) and a second end, distinct from the first end, forming an outlet (9) allowing a rider to exit the trail.

The curve of the sliding trail (2) is configured to form a sliding path between the inlet (7) and the outlet (9) extending in a volume around the rotation axis (4). Thanks to a motorized rotation of the sliding trail (2) about the rotation axis (4), the sliding path is permanently maintained on a slope directed downwards or upwards, depending on the angular position and the curvature of the rotating sliding trail (2).

The support (6) is constructed in such a way to strongly hold the curved sliding trail and to allow its free rotation about the axis (4). A platform (11) provided with stairs or an elevator allows riders to access to the inlet (7) placed in the vicinity of the rotation axis (4).

According to a further embodiment, the slide is provided with a frame structure (1) holding one or a plurality of sliding tubes (2) with fastenings (3) distributed along the outline frame (1*a*) of the frame structure (1) which is also attached to the axial part (5) with fastenings (3). The sliding tube (2) is attached to the frame structure (1) having at least one outline frame (1*a*, 1*b*) of predefined shape and a rotation axis (4) arranged substantially horizontally. The fastenings (3) link at least the outline frame (1*a*, 1*b*) to portions of the curved sliding tube (2). Depending on the shape of the sliding tube curve, some fastenings (3) may also link portions of the tube (2) each other.

Figure 2:
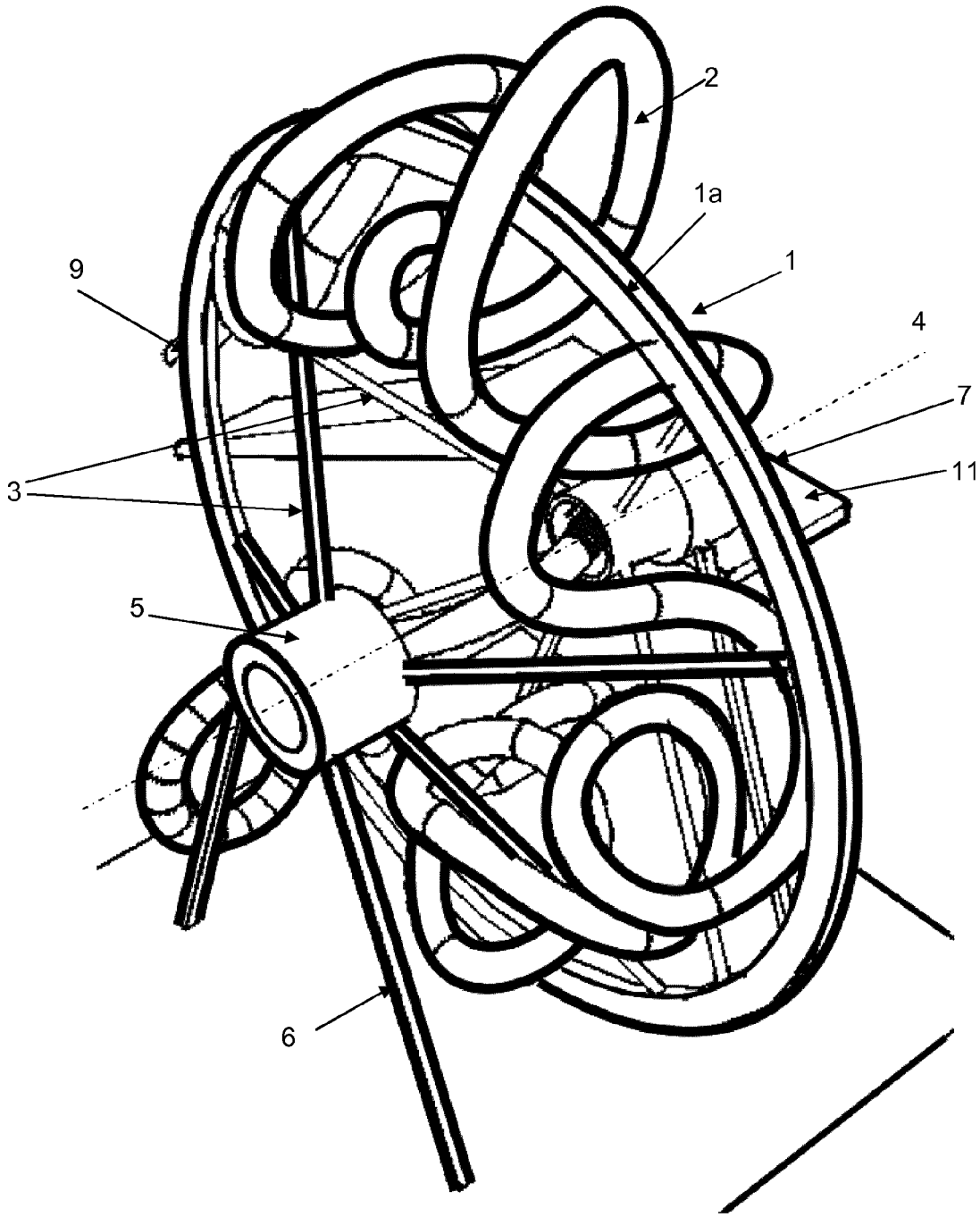
FIG. 2 shows an embodiment of the slide of the invention with a circular frame structure with one outline frame mounted on a support and rotating like a wheel about a horizontal rotation axis arranged on the support
Figure 3:
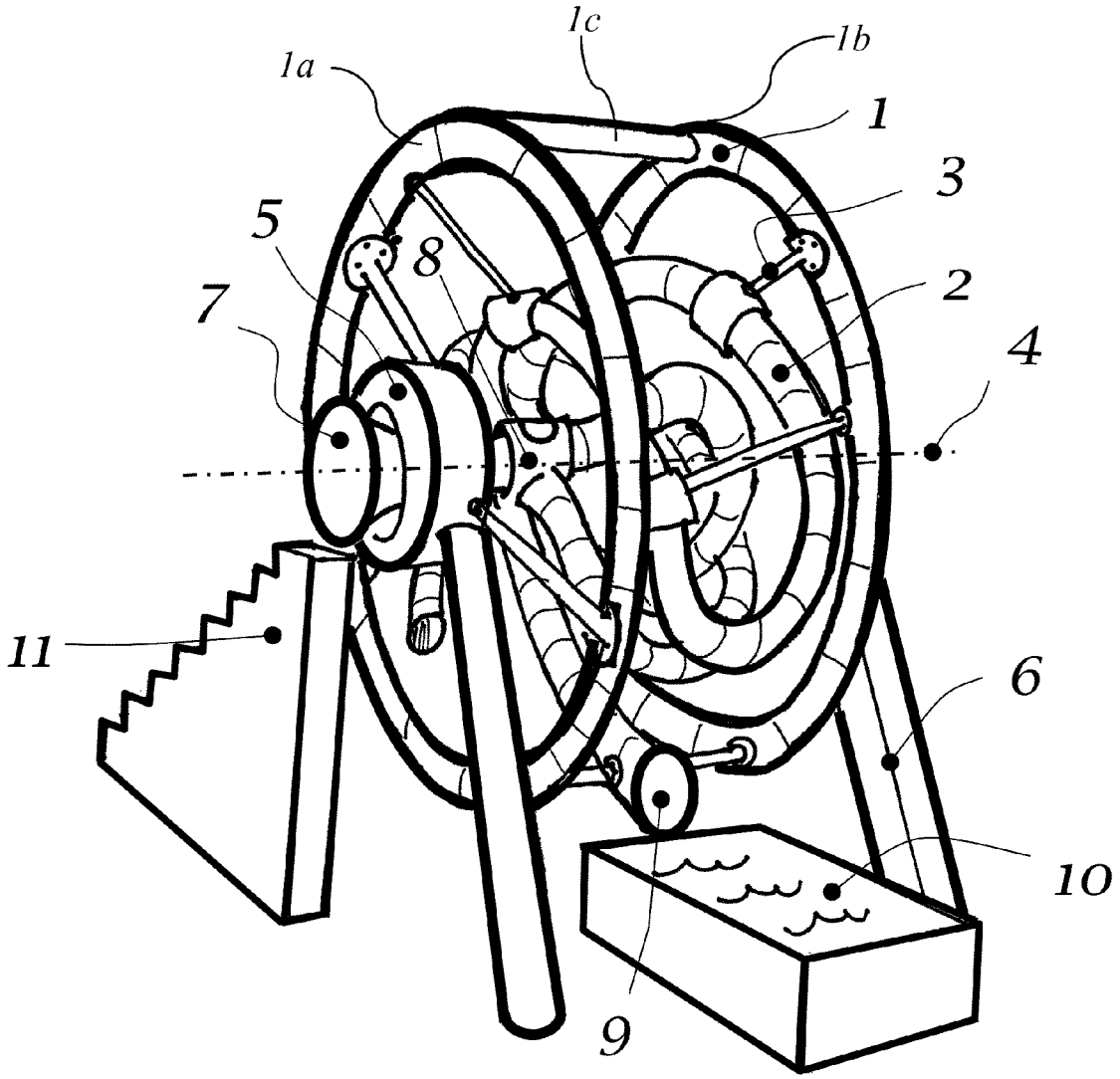
FIG. 3 shows an embodiment of the slide of the invention with a circular frame structure with two opposite outline frames mounted on a support and rotating like a wheel about a horizontal rotation axis arranged on the support.
Figure 4:
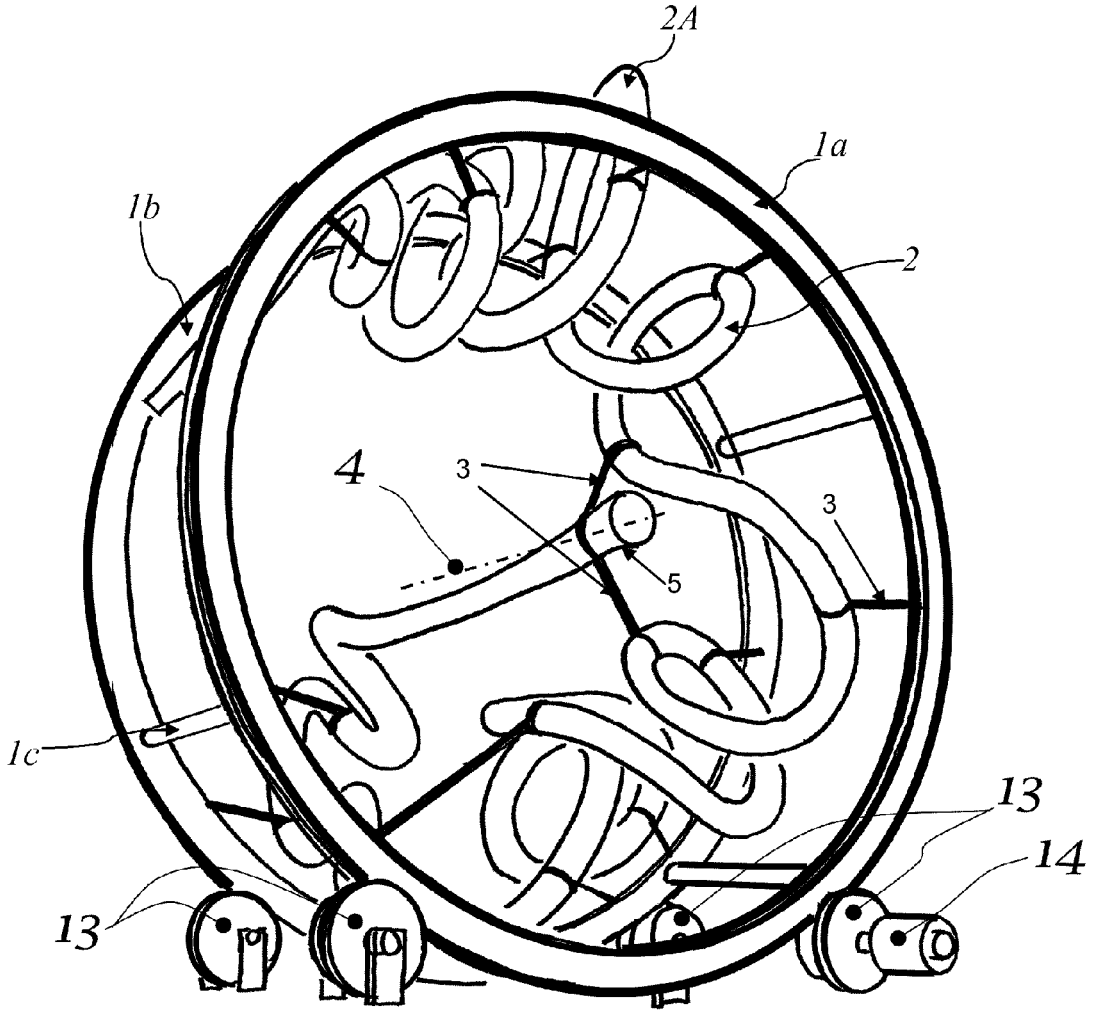
FIG. 4 shows an embodiment where the circular frame structure is mounted on external rollers driving the rotation about the horizontal rotation axis.

The embodiment of FIG. 2 includes one circular outline frame (1*a*) supporting one sliding tube (2) forming circumvolutions turning in a volume around the rotation axis (4) of the circular outline frame (1*a*). The outline frame (1*a*) may have various shapes other than a circle, such as a star or a polygon with rectilinear or curved sides etc. depending on esthetic criteria set by the slide environment According to a further embodiment illustrated by FIG. 3, the frame structure (1) includes two opposite outline frames (1*a*, 1*b*) attached together with spacers (1*c*). As in the example of FIG. 2, the shape of the outline frames (1*a*, 1*b*) may be different from a circle. Furthermore they may be each of different shapes or shifted each other or arranged in quincunx particularly in case of star or polygonal shapes. The sliding tube(s) (2) forming a more or less complex three-dimensional curve attached with the fastenings (3) is arranged around the rotation axis (4) of the frame structure (1) and extends in a volume defined between the two opposite outline frames (1*a*, 1*b*) and also outside by portions in the vicinity of this volume. The examples of FIGS. 3 and 4 show some tubes configurations where turns of the curve go out the frame structure (1). Portions of the curve may project beyond the frame structure (1) out of one or both sides of the outline frame (1*a*, 1*b*) as portions 2B and/or out of the edges of the outline frames (1*a*, 1*b*) as portions 2A.

In both examples of FIGS. 2 and 3, the rotation axis (4) of the frame structure (1) corresponding to a common central axis of the circular frame outlines (1*a*, 1*b*) is mounted substantially horizontally on a support (5, 6) for rotation of the frame structure (1) like a wheel.

The rotation axis (4) may also be slightly inclined relatively to a horizontal plane by forming an angle in a range of some degrees up to about 30 degrees.

Each sliding tube (2) attached to the frame structure (1) includes an inlet connected to a central piece called bifurcator (8) having an axis corresponding to the axis (4) of the wheel shaped frame structure (1). The other end of the sliding tube (2) consisting of the outlet (9) is directed to outside the edge of the frame structure (1). In the example of FIG. 3, the outlet (9) is placed between the two opposite circular outline frames (1*a*, 1*b*). According to an embodiment, the outlet (9) may also end outside the outline frames (1*a*, 1*b*). In case of a slide including several tubes, the outlets of a part of the tubes may be directed outside the outline frames (1*a*, 1*b*) and the outlets of the other part may be directed between them.

In the example shown by FIG. 3, a rider accesses to an entry (7) placed at the center of the wheel by a platform (11) with stairs for example. The entry (7) communicates with the bifurcator (8) connected to the inlets of the tubes (2) which the rider chooses for sliding until the outlet (9) while the frame structure (1) rotates about the axis (4). Thanks to the central position of the entry (7), the rider can access to the inlets of the tubes during rotation of the wheel. Exiting the tubes (2) is also possible during rotation, the rider may fall into a static pool (10), or on a damping mattress, or slides until a conveyor synchronized with the wheel peripheral rotation speed.

According to the configuration of the sliding curve or the position of the entry in particular when the rotation axis (4) is eccentric relative to the inlet (7), the rotation may be stopped to let riders entering into the inlet (7). Depending on configuration of the slide, the rotation may also be stopped to let riders exiting the sliding tube (2).

One or a plurality of sliding three-dimensional curved tubes (2) may be attached to a frame structure (1). The rotation of the frame structure, respectively the tube (2) provides a compensation of riders height loss during slide, due to upwards movement of the tube (2) while riders are sliding inside the tube (s) (2). The curves of the tubes (2) are designed in such a way to be adapted to variable or constant frame rotational speeds providing various speeds and accelerations vectors profiles for riders sliding in the tube(s). For example, tube may be designed for different thrill levels between easy or slow (low thrill) and difficult or fast (high thrill), these tubes being mounted on a same frame structure or wheel. The rotation speed of the frame structure may also vary to provide additional accelerations to the riders according to their position inside the tubes. The sliding tube(s) (2) is (are) preferably provided with sensors arranged inside along the sliding tube. These sensors are configured to detect a position of a rider on the sliding path so that rotation speed of the tube can be controlled. For example if a rider is on an upwards slope, the rotation speed may be accelerated allowing the rider to reach next downwards slope without being stopped. Sensors configured to stop the rotation at entering or exiting of riders may also be positioned at the inlet (7) and outlet (9).

Thanks to the rotation of the frame structure the height of the slide can be reduced for a given speed and sensations for the riders compared to conventional slides which include also curved tubes but starting from a high tower.

The sliding tubes (2) are preferably made in colored opaque, transparent plastic or fiberglass material or in any other appropriate material as stainless steel. The material structure as for example polished or rough internal walls and/or its visual aspect may change in predetermined portions of the tube to provide different sliding speeds and/or respectively decorative effects. The diameter of the sliding tube (2) is adapted to the riders which may slide individually or several in parallel or sit in inflatable rings. In case of a waterslide, the sliding tubes (2) may include water injectors in. arranged inside the sliding tube (2) at positions along the sliding path determined to modify sliding speed by reducing friction of riders sliding inside the tube. Windows of any shape or lamps may also be added to the sliding tubes (2) for providing visual effects and animations during sliding.

FIG. 4 shows an embodiment of a slide with two opposite wheel shaped frame outlines (1*a*, 1*b*). The wheels are placed on four external rollers (13) maintained on the ground and configured for driving the rotation of the fame structure (1) about its rotation axis (4) thanks to a motor (14) installed on one of the rollers (13). This configuration allows a lighter frame structure, and provides possibility to easily exchange the wheel with different sliding tubes configurations.

Figure 5:
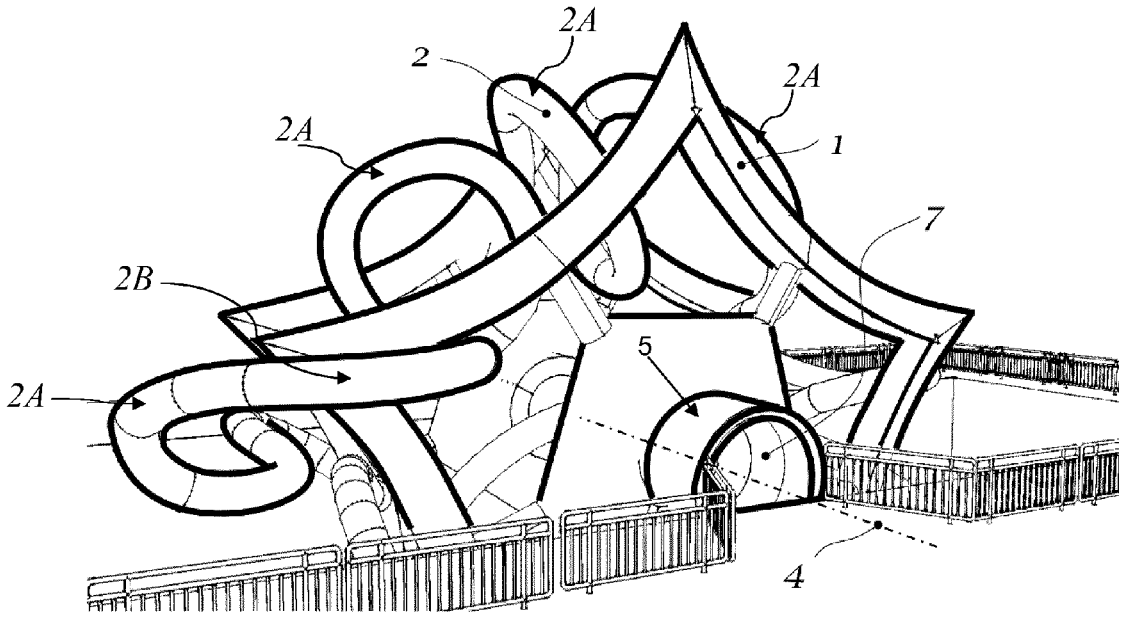
FIG. 5 shows an embodiment with a curved sides star shaped frame structure where the sliding tube inlet is arranged on ground level.

The embodiment of FIG. 5 comprises a frame structure (1) with outline frames in form of a polygon with curved sides. The slide is arranged in a cavity in the ground so that the rotation axis (4) is placed at ground level allowing riders to enter in the tubes without climbing steps, walking a ramp or taking an elevator.

Figure 6:
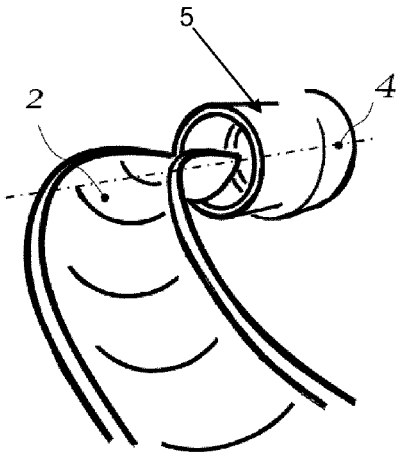
FIG. 6 shows a portion of a half circular sliding tube situated in the vicinity of the inlet at the center of the frame structure.

The sliding tubes may also be open or substantially half circular shaped section along the entire sliding path length or partly along portions of the sliding path length while the remaining portions are made up of closed tubes having a substantially circular shaped section as illustrated by FIG. 6. The open tube portions may for example be positioned near the inlet (7) and/or the outlet (9).

Figure 7:
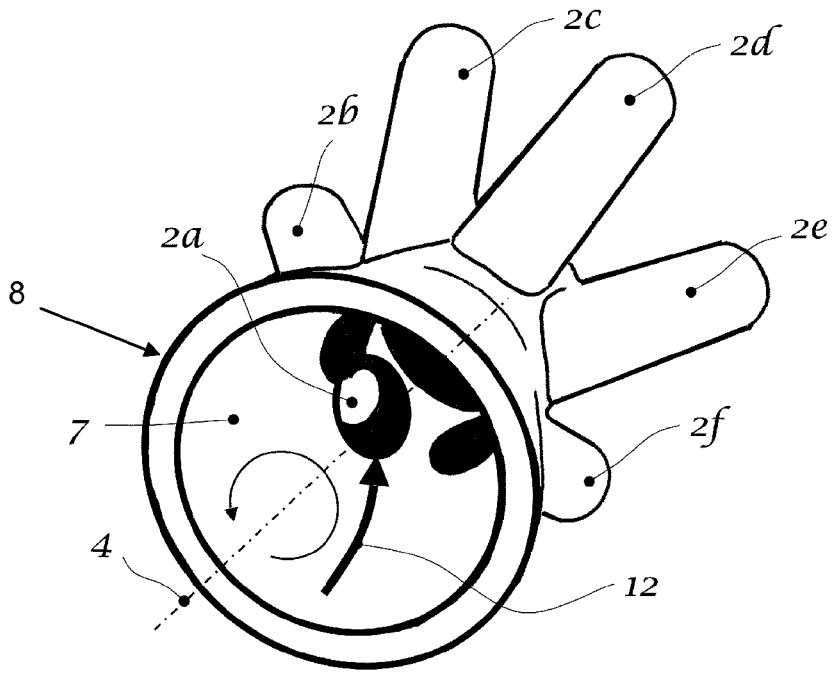
FIG. 7 shows a bifurcator with one entry directing to inlets of several sliding tubes

FIG. 7 illustrate a bifurcator (8) to which are connected the inlet (2*a*, 2*b*, 2*c*, 2*d*, 2*e*, 2*f*) of the sliding tubes (2). The riders enters into the entry (7) (arrow 12) and choose a tube for sliding.

Figure 8:
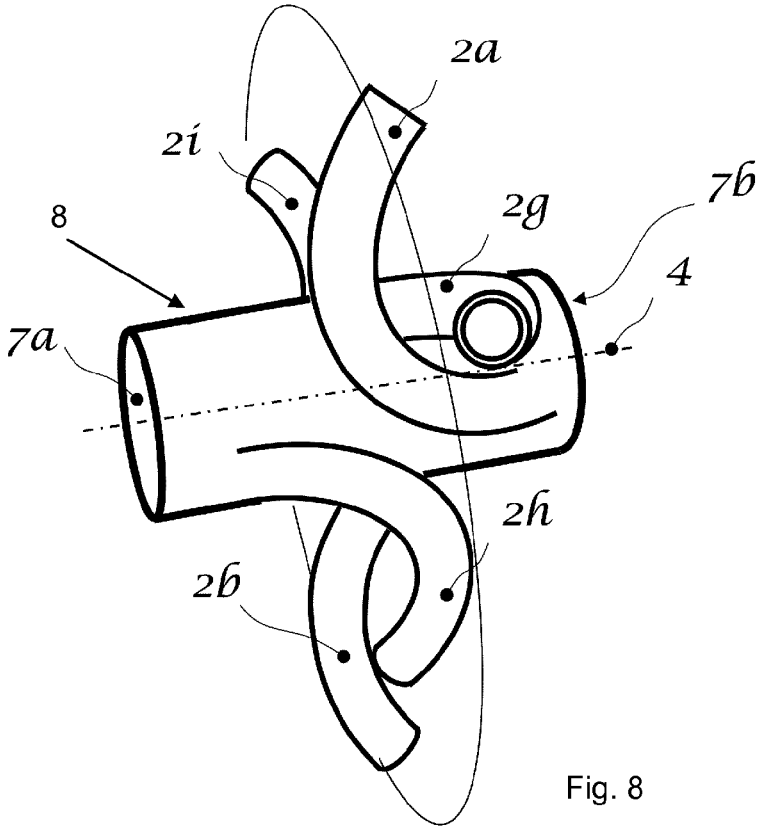
FIG. 8 shows a bifurcator with two opposite entries directing to inlets of several sliding tubes.

The bifurcator (8) of FIG. 8 includes two opposite entries (7*a*, 7*b*) at each side of the volume formed by the sliding tube (2) around the rotation axis (4) or at each side of the frame structure allowing riders to access in tubes inlets (2*a*, 2*b*, 2*g*, 2*h*, 2*i*) leading to tubes directed to opposite axis directions.

According to an embodiment, the rotating frame structure (1) is configured or is configurable to move laterally according to an axis perpendicular to the rotation axis (4) in order to provide a balancing or shacking movement and additional slope variations in the tubes (2).

Figure 9:
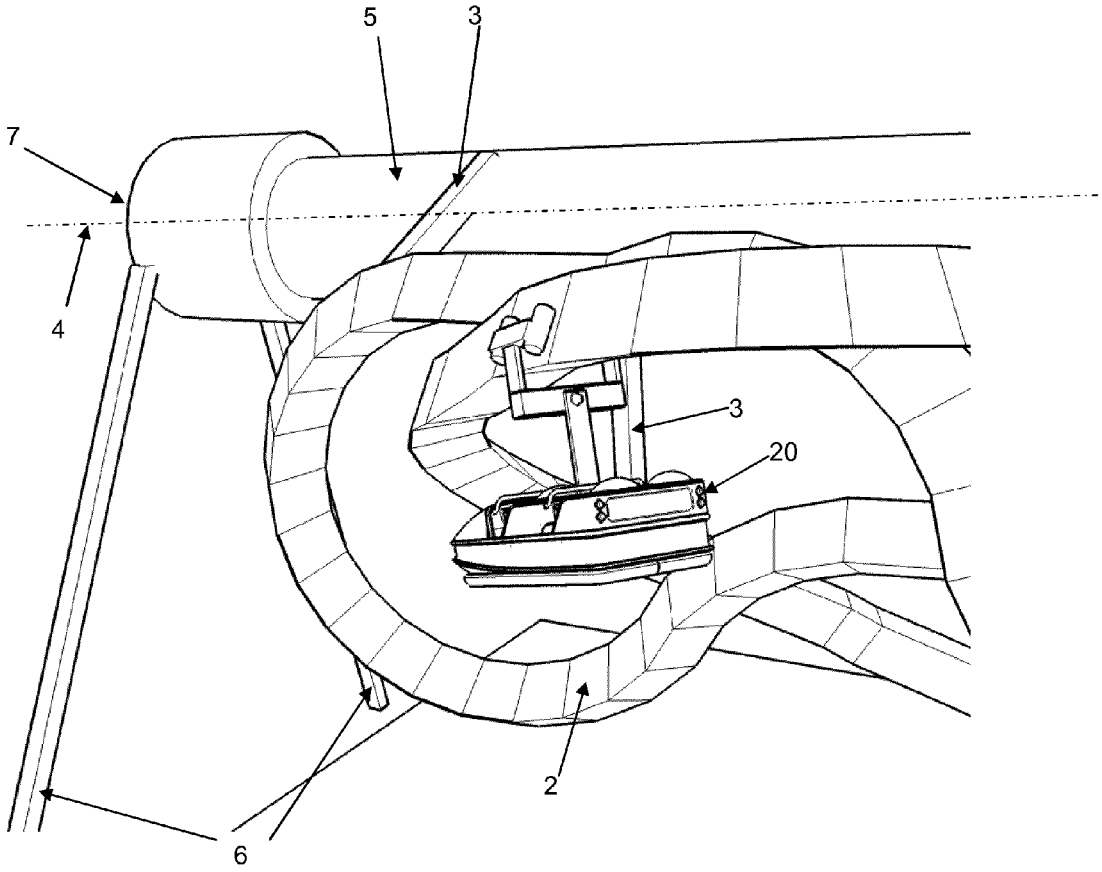
FIG. 9 shows a partial view of an embodiment of the slide of the invention with a three-dimensional curved trail formed by a rail guiding a cart.

According to a further embodiment illustrated by FIG. 9, the sliding trail(s) (2) is (are) made up, instead of a sliding tube, of a sliding rail structure comprising at least one rail following the three-dimensional curve of the sliding path. These rail(s) are configured to guide riding carts or wagons (20) rolling on the rail(s) or sliding by hanging on the rail(s).

According to a further embodiment, the sliding trail (2) is made up of a tube provided with at least one sliding rail arranged inside the tube and configured to guide riding carts or wagons rolling on the rail or sliding by hanging on the rail. The tube may be provided with sliding rails formed by guiding ribs or guiding grooves molded in the material of the internal wall of the tube or rails attached on the internal wall of the tube.

The invention claimed is:

1. An amusement and leisure slide comprising at least one sliding trail forming a three-dimensional curve supported with fastenings linking at least one portion of the at least one sliding trail to an axial part disposed on a support, said axial part being configured to rotate about a rotation axis oriented substantially horizontally, wherein:

the at least one sliding trail includes a first end forming an inlet allowing entry to the trail and a second end, distinct from the first end, forming an outlet allowing exit from the trail; and the curve of the at least one sliding trail is configured to form a sliding path between the inlet and the outlet extending in a volume around the rotation axis, the sliding path having portions perpendicularly oriented relative to the rotation axis, said at least one sliding trail being rotatable about the rotation axis, said at least one sliding trail varying in distance from the rotation axis along the sliding path, said rotation being drivable by a motor.

2. The amusement and leisure slide according to claim 1, wherein the at least one sliding trail is attached to a frame structure having at least one outline frame of predefined shape and a rotation axis arranged substantially horizontally, the fastenings linking at least the outline frame to the axial part and portions of the at least one sliding trail to said outline frame.

3. The amusement and leisure slide according to claim 2, wherein the frame structure is made up of two opposite outline frames attached with spacers.

4. The amusement and leisure slide according to claim 3, wherein the outline frames have a shape selected from the group consisting of circle, star, polygon with rectilinear sides, and polygon with curved sides.

5. The amusement and leisure slide according to claim 1, wherein the inlet of the at least one sliding trail is connected to a bifurcator arranged around the rotation axis, said bifurcator including at least one entry for riders.

6. The amusement and leisure slide according to claim 5, wherein the bifurcator includes two opposite entries placed at each side of the volume formed by the at least one sliding trail around the rotation axis.

7. The amusement and leisure slide according to claim 1, wherein the motor is configured to provide to the at least one sliding trail variable rotational speeds providing various speeds and acceleration vector profiles for riders sliding on the at least one sliding trail.

8. The amusement and leisure slide according to claim 1, wherein the at least one sliding trail is configured or is configurable, in addition to the rotation, to move laterally according to an axis perpendicular to the rotation axis and providing a balancing or shacking movement and additional slope variations in the at least one sliding trail.

9. The amusement and leisure slide according to claim 1, wherein the at least one sliding trail is provided with sensors arranged along the at least one sliding trail, said sensors being configured to detect rider position used to control rotation speed of the at least one sliding trail.

10. The amusement and leisure slide according to claim 9, wherein the at least one sliding trail is equipped with sensors arranged at the inlet and the outlet, said sensors being configured to stop the rotation of the at least one sliding trail at entering or exiting of riders sliding on the at least one sliding trail.

11. The amusement and leisure slide according to claim 1, wherein the at least one sliding trail comprises one or more tubes each having a substantially circular shaped section.

12. The amusement and leisure slide according to claim 1, wherein the outlet of the at least one sliding trail is directed towards a static pool, or a damping mattress, or a conveyor synchronized with the rotation of the at least one sliding trail about the axis.

13. The amusement and leisure slide according to claim 1, wherein the at least one sliding trail comprises one or more open tubes each having a substantially half circular shaped section along the entire sliding path length or partly along portions of the sliding path length and one or more closed tubes having a substantially circular shaped section.

14. The amusement and leisure slide according to claim 1, wherein the at least one sliding trail is made of colored opaque or transparent plastic or fiberglass material or of stainless steel.

15. The amusement and leisure slide according to claim 1, wherein the at least one sliding trail is provided with water injectors arranged inside the at least one sliding trail at positions along the sliding path determined to modify sliding speed of riders sliding inside the at least one sliding trail.

16. The amusement and leisure slide according to claim 1, wherein the at least one sliding trail comprises a sliding rail structure comprising at least one rail following the three-dimensional curve of the sliding path.

17. The amusement and leisure slide according to claim 1, wherein the at least one sliding trail comprises a tube provided with at least one sliding rail arranged inside the tube.

18. The amusement and leisure slide according to claim 1, wherein the rotation axis is inclined relatively to a horizontal plane by forming an angle in a range of zero degrees up to 30 degrees.

19. The amusement and leisure slide according to claim 2, wherein the frame structure comprises one outline frame.

* * * * *